US007066506B2

(12) United States Patent
Pudney

(10) Patent No.: US 7,066,506 B2
(45) Date of Patent: Jun. 27, 2006

(54) SYSTEM FOR PREVENTING INADVERTENT LOCKING OF A VEHICLE DOOR

(75) Inventor: Richard I. Pudney, Plymouth, MI (US)

(73) Assignee: Key Plastics, LLC, Northville, MI (US)

( * ) Notice: Subject to any disclaimer, the term of this patent is extended or adjusted under 35 U.S.C. 154(b) by 267 days.

(21) Appl. No.: 10/675,663

(22) Filed: Sep. 30, 2003

(65) Prior Publication Data

US 2005/0067844 A1 Mar. 31, 2005

(51) Int. Cl.
*E05B 3/00* (2006.01)

(52) U.S. Cl. ..... 292/336.3; 292/DIG. 23

(58) Field of Classification Search ..... 292/336.3, 292/210, 159, DIG. 23, DIG. 31
See application file for complete search history.

(56) References Cited

U.S. PATENT DOCUMENTS 1,583,079 A * 5/1926 Lurie ..... 70/106
2,200,714 A * 5/1940 Falk ..... 292/359
5,011,202 A * 4/1991 Kato et al. ..... 292/336.3
5,895,081 A * 4/1999 Tanimoto et al. ..... 292/348

* cited by examiner

*Primary Examiner*—Gary Estremsky
(74) *Attorney, Agent, or Firm*—Markell Seitzman

(57) ABSTRACT

A lock mechanism (20) for a door comprising: a door handle (110) manually movable from a rest position to an activated position; a first bias spring (170) biasing the door handle to automatically return to the rest position; a lock button (210) movable from an unlocked position to a locked position, wherein when the lock button is in the locked position an associated door lock is locked, thereby preventing the door from being opened and when the lock button is in an unlocked position the door lock is capable of being opened by the door handle when it is moved to the activated position, whereby a quick release of the door handle from its activated position initiates movement of the lock button from the unlocked position to the locked position; the lock mechanism further includes a lever assembly comprising: a programmed lever (300, 302) for blocking the lock button from moving to its locked position in response to the quick release of the door handle, wherein when the lock button is in the locked position an associated door lock mechanism is locked thereby preventing the door from being opened at least from the exterior of the vehicle and wherein the lock button is configured such that when it is in an unlocked position the lock button is capable of inadvertently being moved to its locked position by at least the operation of the door handle.

12 Claims, 4 Drawing Sheets

SYSTEM FOR PREVENTING INADVERTENT LOCKING OF A VEHICLE DOOR

BACKGROUND AND SUMMARY OF THE INVENTION

The present invention relates to latching or locking mechanisms used in motor vehicle doors.

An inspection of the prior art door latch or lock mechanisms shows a common theme. In general door lock mechanisms include manually operable interior and exterior handles, a lock button, a lock and an associated lock bar or pin, as well as a variety of mechanical linkages, cables and springs. Since the present invention is primarily related to mechanisms on the interior side of the door, the exterior door handle and its connecting linkages will not be discussed; additionally, the interface between the exterior door handle and other components of a latch/lock system are well known.

Each of the above components of the door lock mechanism, with the exception of the lock bar or pin, is typically carried by or fitted within a vehicle door. The interior door handle is used to disengage the lock from a lock bar or pin. The lock button is movable and can be manually moved, at least between a locked and an unlocked position. With the lock button in its locked position, the door handle as well as the lock is often prevented from being displaced from the lock bar or pin.

In some installations the interior handle and the lock button are physically separated and have no or only a minimal physical interaction. In other installations the interior handle and lock button are closely situated and are interconnected. One of the performance issues with this latter type of handle/lock installation is the lock button can be inadvertently moved into its locked position by the operation of the interior handle. This inadvertent locking often occurs after the interior handle has been (manually) moved or rotated to its full, active position and then quickly released. Such a quick release might occur if the handle slips out of an occupant's hand while he or she is opening the door while exiting the vehicle, that is, after the handle has been rotated to its full, active position.

An inspection of this last type of door lock mechanism shows the interior door handle and the lock button are indeed physically connected. In some installations this interconnection comprises a pin extending from the lock button, which is received within a cam slot on the interior handle. Movement of the interior handle from its rest position, through a mid-position to its active position also causes the lock button to move from its unlocked position to an over-rotated or an extended position. Subsequently, as the interior lock handle moves back to its rest position (under spring action) the cam slot creates a force on the cam pin in a direction to cause the lock button to rotate back to its unlocked position. However, if the interior handle is caused to rotate at a relatively high velocity as it returns to its rest position, the physical interconnection to the lock button via the cam slot transfers momentum to the lock button, which can cause the lock button to unduly accelerate as it moves or is moved from the extended position to its unlocked position. Consequently, the momentum transferred to the button (from the handle) in combination with spring forces acting on the lock button occasionally causes the lock button to over-rotate and inadvertently come to rest in its locked position.

Other designs of door lock mechanisms replace the above-mentioned cam and cam pin as a means of providing a degree of interconnectivity between the handle and the lock button with a plurality of the extensions, bosses or projections formed on the interior handle and/or the lock button. An inadvertent lock can still occur. When the handle is moved to its active position, one of the projections on the handle moves the lock button from its unlocked position to its extended or over-rotated position. This action is essentially the same as resulted due to the pin and cam slot interaction. A second of these projections contacts or interferes with a portion of the lock button on the return stroke of the interior handle, the effect of which is to transfer momentum to the lock button and urge the lock button toward its locked position.

As can be seen from the above, if the lock button is accelerated through its unlocked position toward its locked condition, inadvertent locking may occur. It is also believed this condition might occur even without the urging, contact or momentum transfer initiated by the interior door handle and might occur if sufficiently high spring bias forces are applied to the lock button directly or indirectly.

Some prior art solutions show the use of expensive viscous damping mechanisms to slow the motion of the door handle, which in turn controls the degree of momentum transfer to the lock button.

It is an object of the present invention to provide a simple and efficient solution to the above problem.

It is a further object of the present invention to provide a blocking mechanism to selectively block or prevent the lock button from inadvertently moving to a locked position after the door handle has been released independent of the speed of the interior door handle.

Accordingly the invention comprises: a door lock mechanism for a vehicle door comprising: a door handle manually movable from a rest position to an activated position; a first bias spring biasing the door handle to automatically return to the rest position; a lock button movable from an unlocked position to a locked position, wherein when the lock button is in the locked position an associated door lock is locked thereby preventing the door from being opened, and when the lock button is in an unlocked position the door lock is capable of being opened by the door handle when moved to the activated position, whereby a quick release of the door handle from its activated position initiates movement of the lock button from the unlocked position to the locked position; the door lock mechanism of the present invention further includes a programmed lever assembly comprising: lever means for blocking the lock button from moving to its locked position.

Many other objects and purposes of the invention will be clear from the following detailed description of the drawings.

DETAILED DESCRIPTION OF THE DRAWINGS

Figure 1:
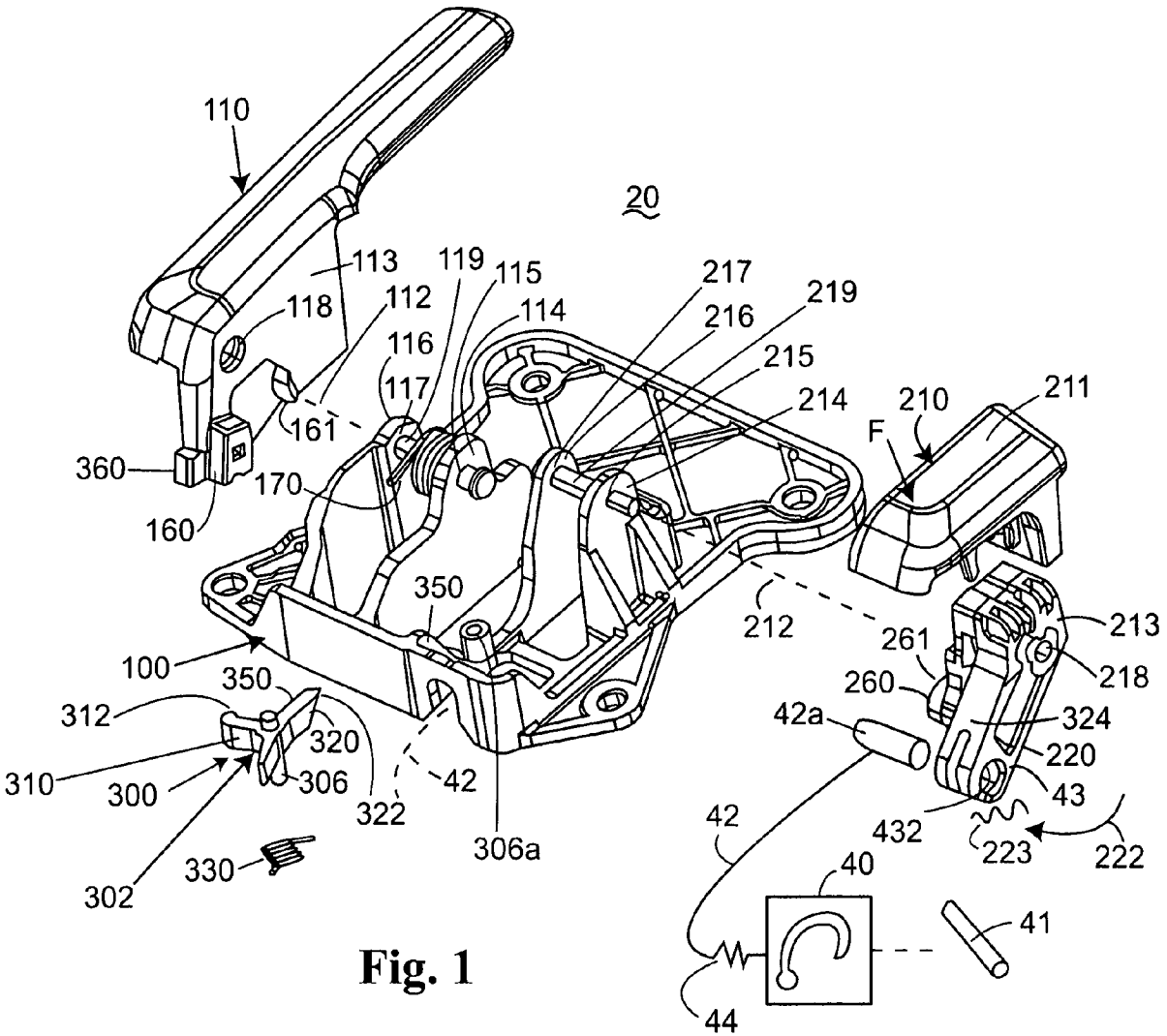
FIG. 1 is an exploded view of the major components of the present invention.
Figure 1A:
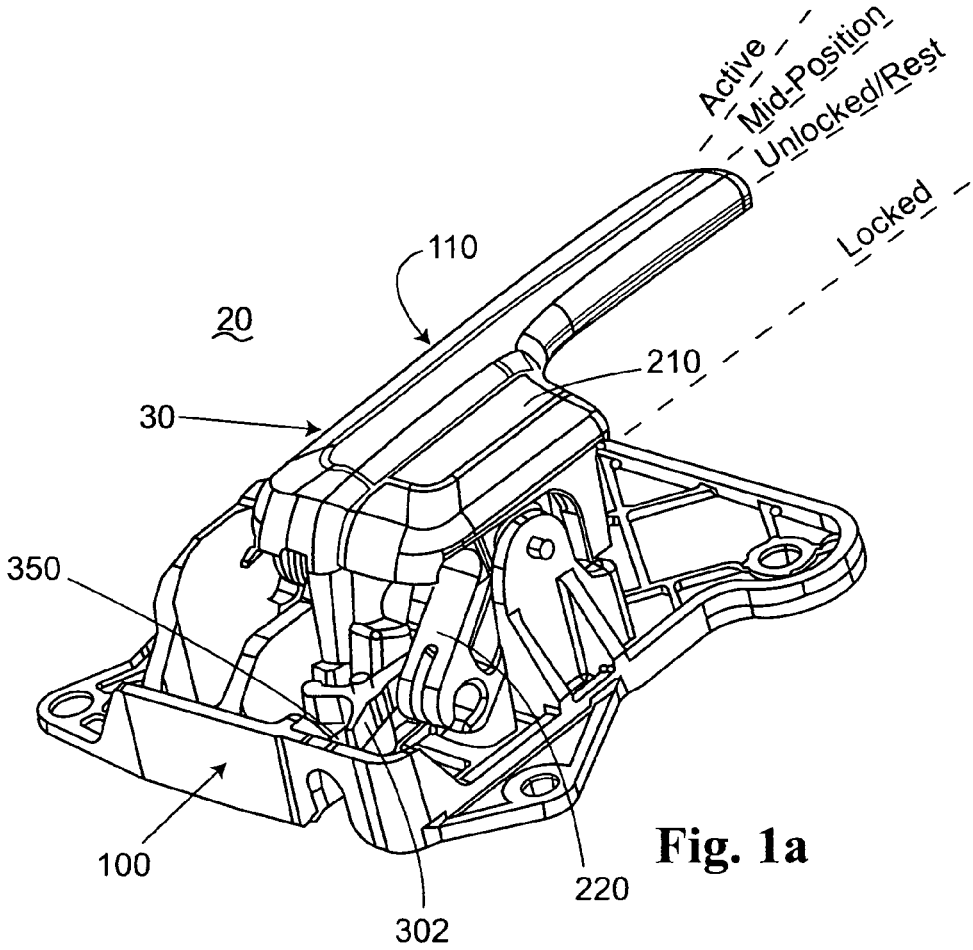
FIG. 1*a* is an isometric view of the present invention.

Reference is briefly made to FIGS. 1 and 1*a*, which illustrate a door lock mechanism 20 incorporating the present invention. The door lock mechanism 20 includes an interior handle/lock button assembly 30 that is operatively communicated to a latch or lock 40, which lockingly engages and disengages from a lock bar or a pin 41 mounted to a structural component, such as a frame or pillar, of the vehicle. The lock 40 and lock bar (a pin) 41 are shown schematically. In general, as known in the art, the lock 40 will include one or more articulated claws or pivoting hooks, to lockingly engage and disengage the bar or pin 41.

The handle/lock button assembly 30 is operatively connected to the lock 40 via cable 42. The cable 42 is spring biased by a bias spring. The bias spring 44 can be located at either end of the cable and for the purpose of illustration is shown associated with the lock 40.

The interior handle/lock button assembly 30 includes a mounting plate or base 100 adapted to be fixedly mounted to a portion of the vehicle door (not shown). For the purpose of reference, when the base 100 is mounted upon a frame of the vehicle door, the plane of the frame is often vertically oriented or slightly angled therefrom. The assembly 30 additionally includes an interior handle 110 and a lock button 210. The handle 110 is pivotally mounted upon the base 100 and is movable about a first axis 112 from a rest position, through a mid-position to a fully rotated, active position (these positions are diagrammatically shown in FIG. 1*a*). The base 100 may include a plurality of pivot points or posts 114 and 116 (which can be integral with the base 100) each having a respective opening 115 and 117. A pivot pin 119 rotatably mounts the interior handle 110 to the pivot points 114 and 116, thereby enabling the interior door handle 110 to rotate about axis 112 (which in this embodiment is generally horizontal). For example, the pivot pin can extend through an opening 118 in an extending body portion 113 of the handle 110, as well as through respective openings 115 and 117 in the pivot points 114 and 116.

The pivoted lock button 210 is positioned in close proximity to the interior handle 110. The lock button 210 is mounted to rotate about a second axis 212. The door handle 110 and the lock button 210 are physically interconnected, for example, by a pin/cam slot or plurality of interfering projections. The lock button in the illustrated embodiment is manually moveable, however, it can also be moved by an actuator such as a solenoid or motor. The axis of rotation 212 may be collinear with axis (of rotation) 112 or offset relative therefrom as shown. The lock button and/or door handle may each be made from a single part or can be fabricated of various mating, joined or snap-together parts. Further, other means of rotatingly supporting the handle and the lock button are within the scope of the present invention.

In the illustrated embodiment the lock button 210 has two parts including an upper body 211 and a lower or depending body 213. In the illustrated embodiment, the depending body 213 is supported in the base 100 for rotation. The body 213 includes an opening 218 to receive a pivot or pin 219. The base 100 may include an additional set of pivot posts 214 and 216. Each of the pivot posts may include a corresponding opening 215 and 217. A pivot pin 219 is received through openings 215, 217 and 218. The pin 219 is mounted collinear with axis 212 and the lock button rotates about pin 219.

The body 213 includes an extending projection or lever portion 220 operably connected to end 43 of the cable 42 in a conventional manner. For example, the cable 42 is terminated in a cylindrically shaped ferrule 41*a* received within a complementary recess 43*a* in the lower portion of the lock button 210. The cable extends through a channel in the base 100. The bias spring 44 biases the lock button 210 toward its locked position (see arrow 222, which diagrammatically shows clockwise rotation about axis 212).

Figure 2:
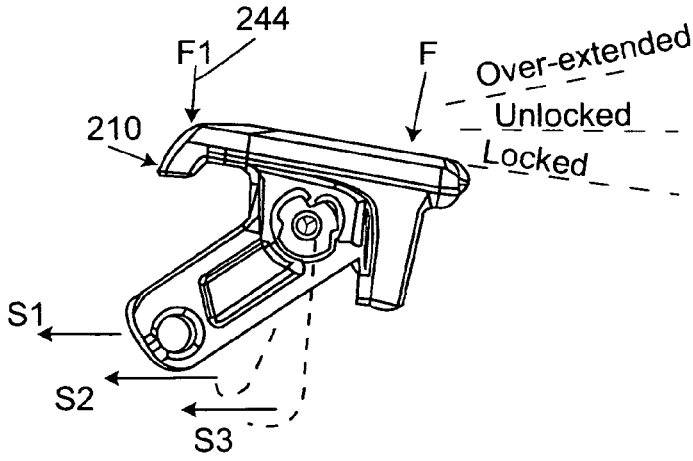
FIG. 2 schematically illustrates the operational positions of a lock button of the present invention.

Reference is briefly made to FIG. 2, which diagrammatically illustrates the lock button 210 in its operational positions (locked, unlocked and over-extended). For purposes of illustration, FIG. 1*a* also shows the lock button in its locked position oriented parallel to the door handle (in its rest position). As can be appreciated, the lock button 210 will achieve its locked position when a force F is applied to a top surface causing the button 210 to rotate to its fullest clockwise position (as shown in FIG. 2). In this position spring 44 applies a bias force of level S1 on the projection 220. The lock button 210 is movable to its unlocked position, designated by dotted line 242, by the application of a force F1 also designated by arrow 244 operating on the left-hand side of button 210 (as seen in FIG. 2). This force F1 rotates the lock button in a counter-clockwise manner with reference to the positions shown in the figures. In this unlocked position the projection 220 extends the spring 44, which now applies a slightly greater bias force designated by S2. As will be seen from the description below, the lock button can be rotated to an overextended position shown by dotted line 246, whereby an even greater force, S3, is exerted on the lock button by the spring 44.

Figure 3:
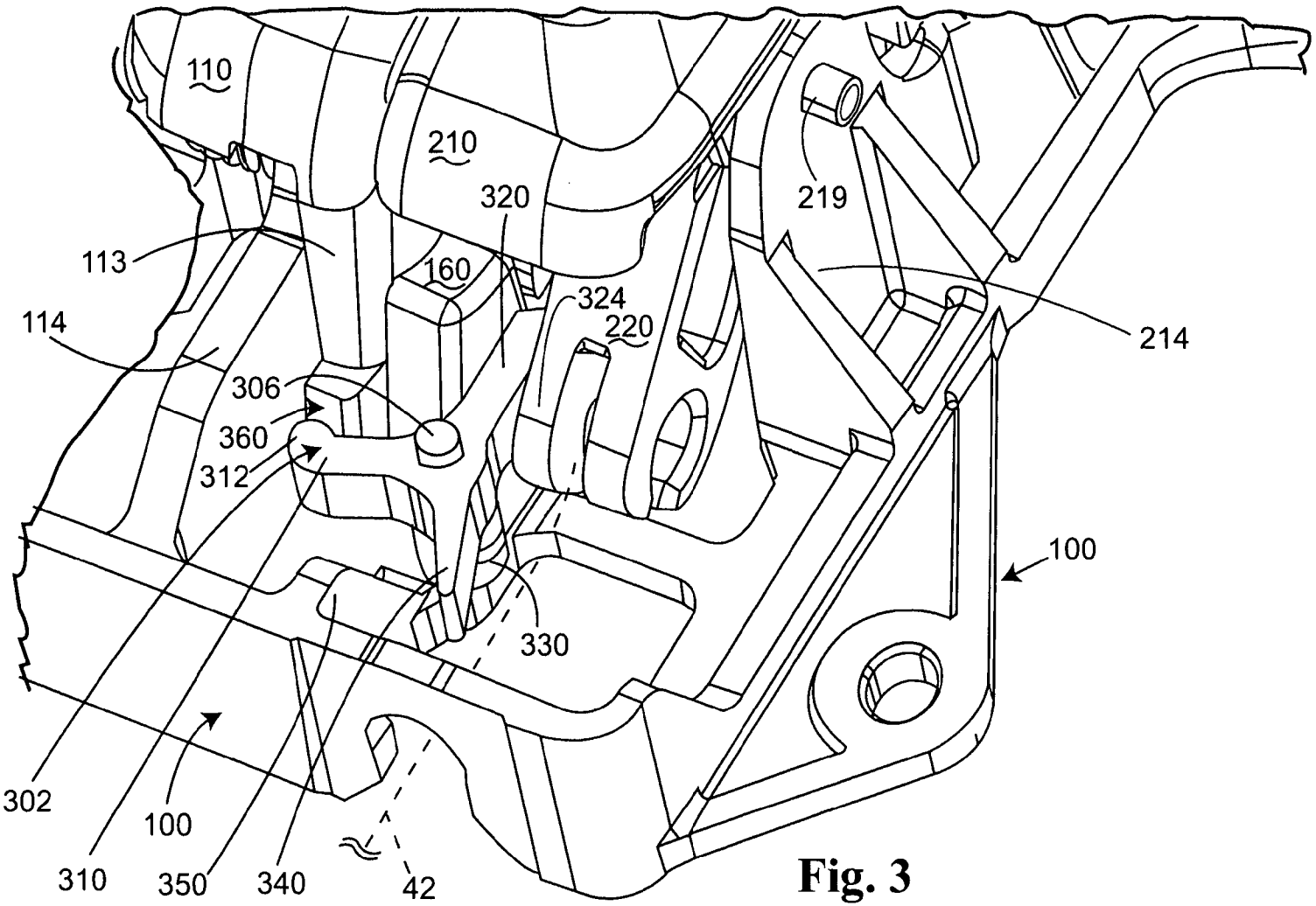
FIG. 3 illustrates an isometric view of a portion of some of the major components of a lock mechanism incorporating the present invention.
Figure 4:
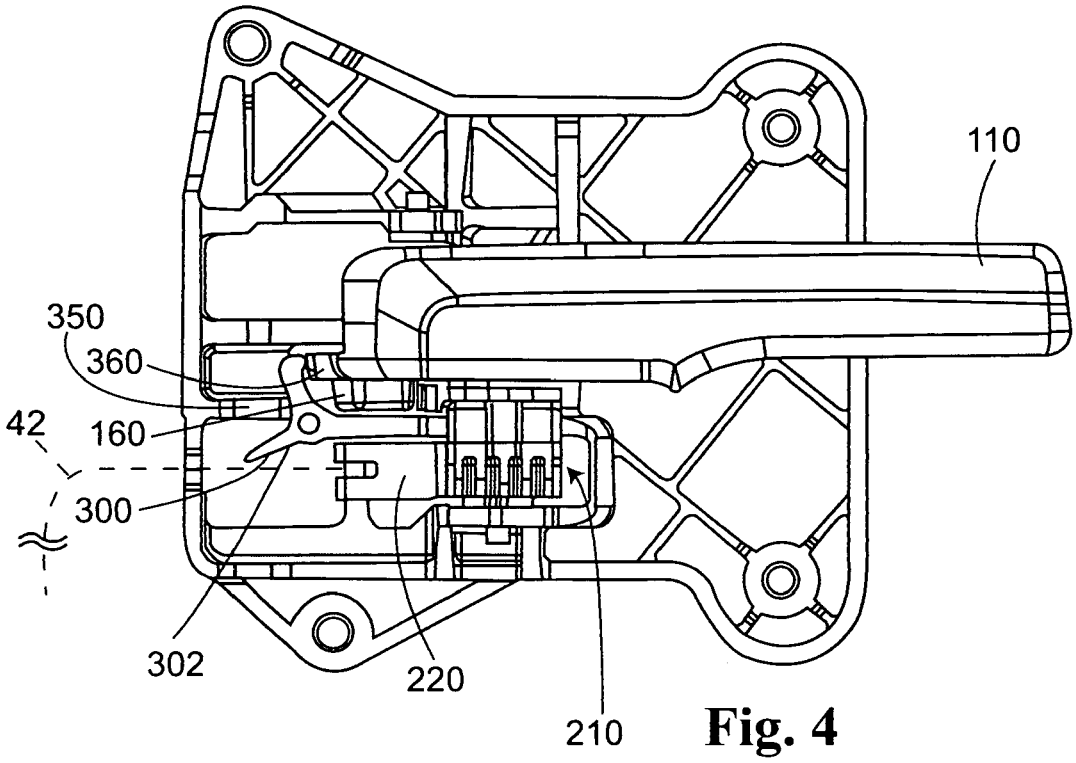
FIG. 4 shows a top plan view of the base, handle and lock button.

Reference is made to FIGS. 1, 3 and 4. FIG. 3 illustrates an isometric view of a portion of the base 100, handle 110 and lock button 210 (in their respective rest and lock positions) and FIG. 4 shows a top plan view of the base, handle and lock button. As shown, the handle 110 also includes a projection 160 extending from the body 113 of handle 110. The projection 160 is an integral part of the rear portion of the handle 110. The projection 160 extends laterally toward the button generally parallel to axis 112 and is operatively connected to or interferes with the button 210. The button 210 includes an interfering projection 260 facing projection 160 and is pushed by projection 160 as the handle 110 is rotated. The handle 110 is biased by a return spring 170 toward its rest position. The spring is positioned about pin 119 and is braced against parts of the base 100 and interior door handle 110. The spring 170 can take many forms. When the interior handle 110 is in its rest position, that is when the handle 110 has been rotated clockwise about axis 112 by spring 170 (as shown in FIGS. 1, 3 and 4), the projection 160 is disengaged from the lock button 210, that is, disengaged from projection 260.

When it is desired to open the door, the handle 110 is grasped and moved from the rest position through its mid-position to its active, fully rotated position. When in the fully rotated position, the lock 40 has been pulled by the cable 42 to an open position disengaged from the pin 41. As mentioned above, when the handle 110 is in the rest position (with the button 210 in the locked position as illustrated in, for example, FIG. 3) the projection 160 is displaced from projection 260. Consequently, the handle 110 can be rotated, about axis 112, a determinable number of degrees (about 12 degrees) before projection 160 engages projection 260 to initiate movement of the button 210 to another operative position. Upon engagement of the projections 160 and 260 and upon further rotation of handle 110, the lock button 210 is rotated counterclockwise about axis 212.

As mentioned, the interior handle 110 is rotated from the rest position to the mid-position to its active position; the lock button 210 is moved (by projection 160 of the handle)

from the locked position to the unlocked position to its over-rotated or extended position (position of maximum rotation). With the handle and lock button in the positions described, the lock 40 is opened, that is, disengaged from the lock bar 41, thereby permitting the door to be opened. When the interior handle is released, spring 170 returns the handle to its rest position whereupon the now opened door is closed and the latch 40 once again reengages the lock bar 41.

Additionally, and as described above, the interior handle 110 and the lock button include interacting mechanisms which reset the lock button from its over-extended position to the unlocked position. These interacting mechanisms can be the above-described pin and cam slot or a plurality of interfering projections or other mechanism, some of which have been described above. In the illustrated embodiment the handle 110 further includes another projection or tab 161 positioned to selectively engage a facing portion 261 of the button on the return motion of the handle to its rest position from its extended position. The facing portion 261 can be an interfering part of the projection 260.

In the above-described button/handle configuration and as mentioned above, if the lock handle is gradually repositioned from its active position to the rest position, the lock button moves slowly, under the influence of the physical interconnection and under the influence of lock spring 44 from its extended position to its unlocked position and does exhibit inadvertent locking. However, if the lock button is unduly accelerated it might overshoot the unlocked position and come to rest in the locked position. Once the door is closed the vehicle door is obviously locked.

To prevent the inadvertent locking of the door, the present invention includes a blocking lever assembly generally identified in the figures by numeral 300. The assembly 300 includes a multi-armed pivoted, programmed lever 302 rotationally mounted to the base 100, a cam (or projection) 360 formed on handle 110 and other parts. In the illustrated embodiment cam 360 is configured as a simple projection extending from the body 113 of the handle 110. As can be seen in the figures, a pin 306 supports the lever 302; the pin 306 is rotationally received within a bore or bushing **306*a* integrally formed in the base 100. As can be appreciated, the pin 306 can be hard mounted to the base, in which case the lever 302 is rotatably mounted on the pin 306. The lever 302 or the pin 306, as the case may be, is rotationally biased by a spring 330. The lever 302 includes a cam arm 310 and a cam follower 312 formed at a distal end thereof. The programmed lever 302 further includes a blocking arm 320, which is angularly offset from arm 310. A remote end of blocking arm 320 is formed into a blocking surface 322. The length of the blocking arm 320 can be configured to position the blocking surface 322 slightly apart from a flat contact surface 324 of the projection or lever portion 220 of the lock button 210 when the lock button has been rotated to its unlocked position. In this manner the lock button is free to over-rotate a few degrees prior to the lock button contacting the blocking surface 322**. This extra degree of freedom ensures the lock button has positively moved into its unlocked configuration.

Figure 6:
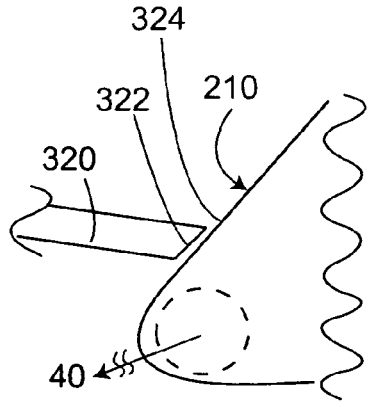
FIG. 6 shows a blocking lever in its blocking position.
Figure 5:
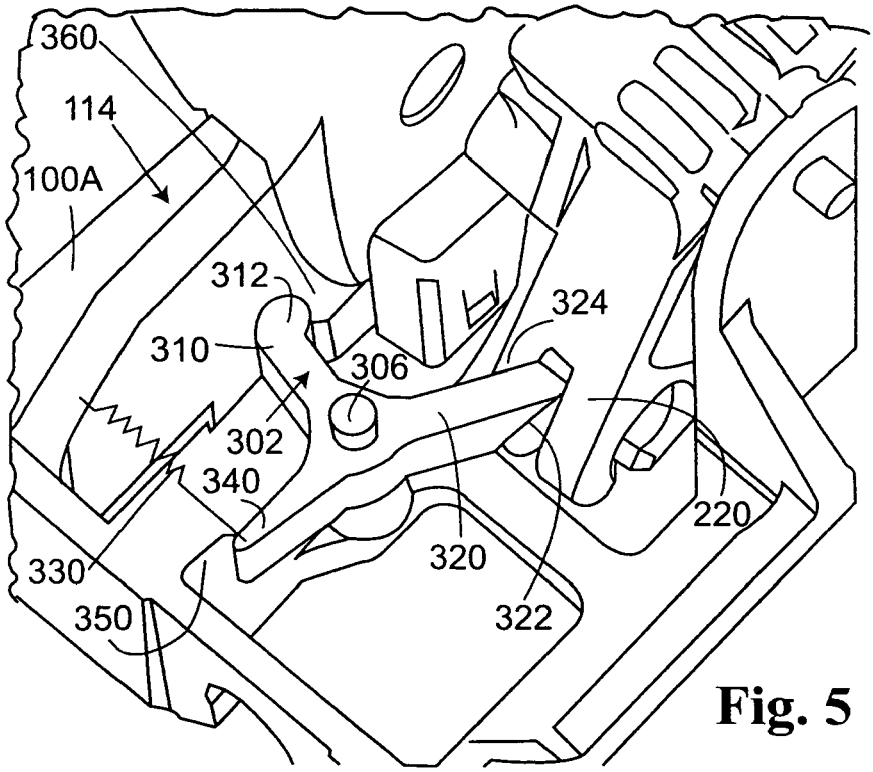
FIG. 5 shows some of the major components of the present invention in a locked operative state.

As can be seen from FIGS. 1, 5 and 6, the blocking surface 322 is angled or chamfered. This chamfered configuration permits the blocking surface 322 to fully engage the surface 324 when the projection 220 has returned to the unlocked position or slightly over-rotated therefrom.

Reference is briefly made to FIG. 6, which illustrates the orientation between the blocking surface 322 and contact surface 324 (with the projection 220 slightly over-rotated passed the unlocked position of the lock button).

The base 100 further includes a spring stop 350, which limits the amount arm 340 can rotate and insures the blocking arm 320 is stopped at the correct position to insure the blocking of the lock button 210. In the illustrated embodiment, spring arm 340 engages the spring stop 350, however, various other mechanical stops can be used. For example, arms 310 or 340 can be stopped.

When handle 110 is in its rest position as shown in FIGS. 1, 3 and 4, for example, the cam 312 of lever 302 is biased by spring 330 and rests upon the projection 360 of the handle 110 (also biased to its rest position by spring 170). When the interior handle 110 is rotated from its rest position into its mid-position by an amount as small as for example 12 degrees, such added rotation begins moving button 210, thus moving the projection or lever portion 220 away from the blocking arm 340, which previously had been located in a space between the handle and button. Such rotation now frees the cam 312 (from the projection 360) and blocking lever 340 from button 210 and permits the programmed lever 302 (and its component parts including the blocking arm 320) to rotate, under the influence of spring 330, in a clockwise manner (in relationship to the illustrations) into the blocking position shown in FIG. 5.

FIG. 5 also shows an alternate spring 330 secured between stop 350 and lever arm 340. The rotation of the lever 302 is stopped in the correct blocking position when arm 340 engages stop or wall 350. As can be appreciated, any further rotation of the handle 110 through its mid-position to its fully rotated or activated position has no further effect on the position of the lever assembly 302, as the lever assembly 302 has already moved to its fully rotated, blocking position, as illustrated in FIGS. 5 and 6.

Thereafter, if handle 110 is quickly released, from a position in which the handle has a sufficiently high level of kinetic energy (created by the return spring 170) the momentum of the handle will be transferred to the lock button due to the mechanical interaction between the handle and the lock button. With the lever 302 and particularly the blocking lever 320 in its blocking position (which occurs upon the pull stroke of the interior handle and subsequent movement of the lock button), the button 210 will be prevented from moving past the unlocked position to the locked position regardless of the level of momentum transferred from the handle to the lock button. This condition is also schematically shown in FIG. 6, which illustrates the blocking lever 320 in contact with surface 324 of projection 220. As mentioned the lock button is permitted to rotate slightly past its unlocked position in the manner described above.

The programmed lever 302 is reset to the positions shown in FIGS. 3 and 4 upon the return of the handle 110 to its rest position. More particularly, as the handle 110 returns to its rest position under the influence of bias spring 170, the projection 360 swings back into its null or rest position, once again contacting the cam 312 of lever arm 310. This contact pushes the programmed lever 302 in a counterclockwise manner causing the blocking lever arm 320 to disengage from the button 210 (which is in its unlocked position). Upon disengagement of the blocking lever arm 320, the button 210 can then be manually pushed when desired to its unlocked position.

Modifications in the above-described embodiment of the invention can, of course, be carried but without departing from the scope thereof. Accordingly, that scope is intended to be limited only by the scope of the appended claims.

The invention claimed is:

1. A door lock mechanism for a door comprising:

a door handle configured to be moved from a rest position to an activated position by a user thereof;

a first bias spring biasing the door handle to return to the rest position;

a lock button movable at least from an unlocked position to a locked position, wherein when the lock button is in the locked position an associated door lock mechanism is locked thereby preventing the door from being opened at least from an exterior of a vehicle and wherein the lock button is configured such that when it is in an unlocked position the lock button is capable of being moved to its locked position by at least the operation of the door handle;

the lock mechanism and lock button being configured such that a release of the door handle under certain conditions from its activated position initiates movement of the lock button to its locked position;

the lock mechanism further includes a lever assembly for blocking the lock button from moving to the locked position of the lock button in response to a return movement of the door handle from its actuated position to its rest position wherein the lock mechanism further includes bias means for selectively biasing the lever assembly to move toward a blocking position.

2. The lock mechanism as defined in claim 1 including stop means for preventing the lever assembly from rotating beyond a desired blocking position.

3. A door lock mechanism for a door comprising:

a door handle configured to be moved from a rest position to an activated position by a user thereof;

a first bias spring biasing the door handle to return to the rest position;

a lock button movable at least from an unlocked position to a locked position, wherein when the lock button is in the locked position an associated door lock mechanism is locked thereby preventing the door from being opened at least from an exterior of a vehicle and wherein the lock button is configured such that when it is in an unlocked position the lock button is capable of inadvertently being moved to its locked position by the operation of the door handle;

the lock mechanism and lock button being configured such that a release of the door handle under certain conditions from its activated position initiates movement of the lock button to its locked position;

the lock mechanism further includes a lever assembly for blocking the lock button from moving to the locked position of the lock button in response to a return movement of the door handle from its actuated position to its rest position;

wherein the door handle is configured to rotate about a first axis and wherein the lever means is configured to rotate about a second axis, wherein the second axis is substantially perpendicular to the first axis.

4. The lock mechanism as defined in claim 3 wherein the lock button is configured to rotate about a third axis, the third axis being generally parallel to the first axis.

5. The look mechanism as defined in claim 3 including stop means for preventing the lever assembly from rotating beyond a desired blocking position.

6. A door lock mechanism for a door comprising:

a door handle configured to be moved from a rest position to an activated position by a user thereof;

a first bias spring biasing the door handle to return to the rest position;

a lock button movable at least from an unlocked position to a locked position, wherein when the lock button Is in me locked position an associated door lock mechanism is locked thereby preventing the door from being opened at least from an exterior of a vehicle and wherein the lock button is configured such that when it is in an unlocked position the lock button is capable of being moved to its locked position by at least the operation of the door handle;

the lock mechanism and lock button being configured such that a release of the door handle under certain conditions from its activated position initiates movement of the lock button to its locked position;

the lock mechanism further includes a lever assembly for blocking the lock button from moving to the locked position of the lock button in response to a return movement of the door handle from its actuated position to its rest position wherein the door handle is configured to rotate about a first axis and wherein the lever means is configured to rotate about a second axis, wherein the second axis is perpendicular to the first axis.

7. The lock mechanism as defined in claim 6 including stop means for preventing the lever assembly from rotating beyond a desired blocking position.

8. A door lock mechanism for a door comprising:

a door handle configured to be moved from a rest position to an activated position by a user thereof;

a first bias spring biasing the door handle to return to the rest position;

a lock button movable at least from an unlocked position to a locked position, wherein when the lock button is in the locked position an associated door lock mechanism is locked thereby preventing the door from being opened at least from an exterior of a vehicle and wherein the lock button is configured such that when it is in an unlocked position the lock button is capable of being moved to its locked position by at least the operation of the door handle;

the lock mechanism and lock button being configured such that a release of the door handle under certain conditions from its activated position initiates movement of the lock button to its locked position;

the lock mechanism further includes a lever assembly for blocking the lock button from moving to the locked position of the lock button in response to a return movement of the door handle from its actuated position to its rest position including sequencing means for moving the lever assembly to a position remote from the lock button.

9. The lock mechanism as defined in claim 8 wherein the lever assembly sequencing means is configured to be moved to the remote position as the door handle returns to its rest position.

10. The lock mechanism as defined in claim 8 further including a lock button bias means for biasing the lock button toward the lock position.

11. The lock mechanism as defined in claim 10 including stop means for preventing the lever assembly from rotating beyond a desired blocking position.

12. The lock mechanism as defined in claim 8 including stop means for preventing the lever assembly from rotating beyond a desired blocking position.

* * * * *